US006361227B1

(12) United States Patent
Hosoi

(10) Patent No.: US 6,361,227 B1
(45) Date of Patent: Mar. 26, 2002

(54) OPTICAL WRITING PRINTER HEAD AND PRINTER USING THE SAME

(75) Inventor: Yuji Hosoi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/448,577

(22) Filed: Nov. 23, 1999

(30) Foreign Application Priority Data

Nov. 26, 1998 (JP) ..... 10-336031

(51) Int. Cl.[7] ..... B41J 2/00
(52) U.S. Cl. ..... 400/118.2; 347/248
(58) Field of Search ..... 400/118.2; 347/232–234, 347/238, 248

(56) References Cited

U.S. PATENT DOCUMENTS 3,595,208 A * 7/1971 Koizumi ..... 118/637
5,648,810 A * 7/1997 Tanuma et al. ..... 347/130

FOREIGN PATENT DOCUMENTS

JP 403132369 A * 6/1991
JP 06198958 A * 7/1994
JP 06270471 A * 9/1994

* cited by examiner

*Primary Examiner*—John S. Hilten
*Assistant Examiner*—Charles H. Nolan, Jr.
(74) *Attorney, Agent, or Firm*—Adams & Wilks

(57) ABSTRACT

An optical writing printer head capable of reducing the printing time in the proportion to the print resolution (dot density) is provided. An optical writing printer head 14 is designed to print onto a sheet of photosensitive print paper, which is intermittently fed at a constant paper feeding pitch Qp in a paper feeding direction Z, by irradiating light onto the print paper when the paper is scanned in a scanning direction X intersecting the paper feeding direction Z, and is provided with a first light source group Sr in the paper feeding directgion. The first light source group Sr includes N pieces of light sources Sr2, Sr3 of one color which are arrayed along the paper feeding direction Z at the standard pitch Qs of 1/N of the paper feeding pitch Q, where N is a natural number which is 2 or larger. The first light source group Sr further includes an upstream side light source Sr1 of the one color at an interval corresponding to the standard pitch Qs positioned at an upstream side of the light sources Sr2, Sr3 with respect to the paper feeding direction Z, and the upstream side light source Sr1 has a length Lr1 in the paper feeding direction Z equal to (N−1) times the standard pitch Qs.

25 Claims, 4 Drawing Sheets

OPTICAL WRITING PRINTER HEAD AND PRINTER USING THE SAME

BACKGROUND OF THE INVENTION

1. Field of the Invention

The present invention relates to an optical writing printer head for printing onto sheets of photosensitive print paper, which are intermittently fed at a constant pitch (paper feeding pitch) in a paper feeding direction, by applying light energy to (exposing) the print paper when the sheets of paper are scanned in a scanning direction intersecting the paper feeding direction, and to a printer using such a printer head.

2. Description of the Related Art

The phrase "paper feeding pitch" as used herein indicates a sheet length of the print paper that is fed during a period starting from one exposure scanning operation to the subsequent exposure scanning operation while the sheets of print paper are intermittently fed in a paper feeding direction. The paper feeding pitch may be larger than a unit of length of the intermittent feed performed by a paper feeding means.

A conventional optical writing printer head of this type is provided with light source groups of three colors which are arranged in a scanning direction orthogonal to a paper feeding direction at a certain interval. The light source group of each color consists of a plurality of light sources practically having the same size which are arranged at the paper feeding pitch in the paper feeding direction. More specifically, in the conventional printer head of this type, a sub-region on a sheet of print paper is exposed to light from a first light source of one color. Then, light from a subsequent light source of the one color which is positioned at the downstream side of the paper feeding direction is further irradiated onto the sub-region while the sheet of paper is intermittently fed pitch by pitch. Thus, a print of a predetermined dot (a latent image formation) is performed. It should be noted that each light source is composed of a light source body formed of an LED (light emitting diode), and an aperture (diaphragm) formed before the light source body. The respective apertures of the light sources having substantially the same size are arranged at an equal interval along the paper feeding direction and the scanning direction, respectively.

However, in the conventional printer head of this type, as the pitch of the light sources coincides with a paper feeding pitch, the pitch of dots formed by the light sources coincides with the paper feeding pitch, so that the number of exposure controls for columns in the paper feeding direction becomes equal to or more than the number of rows in the paper feeding direction. If the print resolution (i.e., density of the dots to be printed on a sheet of print paper, or, in other words, the number of dots per unit of length in the paper feeding direction of the print paper) is high, the printing time will be hardly avoided from being long.

For example, if an exposure time per dot is 480 microseconds, the number of dots in the scanning direction is 320 dots per line, the inverse time in the scanning direction at the end of the scanning direction (the end of one row) is 0.05 seconds, and the number of dots (the number of rows) in the paper feeding direction is 144 dots, it will take the printing time of $(480\times320\times10^{-6}+0.05)\times144$ seconds, i.e., approximately 29.3 seconds.

SUMMARY OF THE INVENTION

The present invention has been devised in view of the foregoing drawbacks, and an object of the present invention is to provide a printer head capable of reducing the printing time in the proportion of the print resolution (dot density), and an optical writing printer using such a printer head.

This object is attained with an optical writing printer head for printing onto sheets of photosensitive print paper, which are intermittently fed at a constant paper feeding pitch in a paper feeding direction, by irradiating light onto the print paper when the paper is scanned in a scanning direction intersecting the paper feeding direction. The printer head according to the present invention is provided with a first light source group in the paper feeding direction, the first light source group including N light sources of one color which are arrayed along the paper feeding direction at the standard pitch of 1/N of the paper feeding pitch, where N is a natural number which is 2 or larger.

In the printer head according to the present invention, N light sources in the first light source group are arrayed at the standard pitch of 1/N of the paper feeding pitch along the paper feeding direction. Therefore, a simultaneous exposure (print such as a latent image formation) with N dots can be carried out using the N light sources for each pitch of the paper feed.

That is, according to the present invention, when the printer head has a print resolution identical with that of the conventional printer head, the pitch of the N light sources will coincide with the pitch of light sources in the conventional printer head. On the other hand, while the conventional printer has a pitch of the light sources in coincidence with the paper feeder pitch, the printer head of the present invention has a pitch of the N light sources corresponding to 1/N of the paper feeding pitch. Thus, the paper feeding pitch amounts to N times the paper feeding pitch in the conventional printer, so that the print speed amounts to substantially N times that of the conventional printer. In other words, with the same print resolution as that of the conventional one, a higher print speed will be attained, and the printing time will be reduced in proportion to the print resolution (dot density).

If a printer having a paper feeding pitch identical with the paper feeding pitch of the conventional printer, in the printer head of the present invention, the pitch of the N light sources equals to 1/N of the paper feeding pitch,a mounting to 1/N as compared with the pitch of the light sources in the conventional printer head which coincides with the paper feeding pitch. Therefore, the printer head of the present invention can practically print at the print resolution increased by a factor of N (dot pitch of 1/N) during the same printing time as that of the conventional one. That is, with the same printing time as that of the conventional one, a higher print resolution can be achieved, and the printing time will be reduced in proportion to the print resolution (dot density).

The phrase "standard pitch" as used herein means a minimum distance between the centers of the adjacent dots formed on the paper along the paper feeding direction (a dot pitch having the maximum resolution formed on the print paper). This coincides with a minimum distance between the centers of the adjacent light sources that form the adjacent light sources that form the adjacent dots. The "scanning direction" is typically orthogonal to the paper feeding direction, but it need not be orthogonal thereto in some cases so long as to intersect in direction. The number "N" is a natural number equal to 2 or 3, for example, but can also be 4 or more.

In terms of the N light sources, the "one color" means a color corresponding to a specific wavelength area such as red, blue or green. Note that it includes a color consisting of light in a plurality of wavelength areas, also including white color. Typically, the N light sources have the ability of emitting beams having substantially the same sectional shape, sectional area (size), angle of divergence, maximum intensity, etc., but at least any of these factors may be different in some cases.

Preferably, the first light source group includes an upstream side light source of the one color at an interval corresponding to the standard pitch positioned at the upstream side of the N light sources with respect to the paper feeding direction, and the upstream side light source has a length in the paper feeding direction equal to (N−1) times the standard pitch. The phrase "interval corresponding to the standard pitch" as used herein means an interval where the distance in the paper feeding direction between the center of the light source positioned at the most upstream side among the N light sources and the center of the most downstream side portion or region of the upstream side light source which is required to form on the print paper a dot having substantially the same shape as that of the dot formed by the most upstream side light source (the most downstream side light emitting region among the light emitting regions of the upstream side light sources, which has the same shape as that of the light emitting region of the most upstream side light source) coincides with the standard pitch. Typically, the upstream side light source having a length equal to (N−1) times the standard pitch and the N pieces of light sources at the downstream side thereof in the first light source group are arrayed in a line at the same position in the scanning direction, i.e., along the paper feeding direction, in a linear manner. In some cases, however, these light sources can be arranged in the position shifted in the scanning direction.

In this case, a "pre-exposure" is carried out on the print paper by the upstream side light source, and the paper can be pre-exposed by the N light sources positioned at the downstream side so that N pieces (N dots) of independent latent images may be formed thereon. The phrase "pre-exposure" as used herein means an irradiation of the light to photosensitive print paper on which a latent image can be formed when the light having the light amount equal to or more than a predetermined threshold value (threshold energy) reaches, and on which a latent image having the greatly varied density when it is developed relative to a change in the light amount can be formed at the level exceeding the threshold energy. The above light is irradiated having a level (light amount) less than the threshold at which a latent image can be formed on print paper but having a level near this threshold. Onto a portion of the print paper which is subjected to pre-exposure can form a latent image having the sensitively varied density when it is developed relative to a change in the light amount at the level exceeding the threshold value. Therefore, even if the beam intensity of the N pieces of light sources at the downstream side is relative low, the beam intensity of each of these N pieces of light sources is slightly changed and controlled, whereby a latent image having the desired density of N dots can be formed on the portion of the print paper which has been pre-exposed. This facilitates to photosensitize the print paper area that has been pre-exposed to the extent that it can be substantially saturated.

Preferably, the N pieces of light sources in the first light source group are composed of an aperture means having N pieces of apertures (diaphragms) arrayed at the standard pitch along the paper feeding direction, and N pieces of light source bodies arranged at an interval behind the aperture means so as to confront the apertures, respectively.

Further, preferably, the upstream side light source having a length increased by a factor of (N−1) is composed of: a light source body; and an aperture in an elongated hole form having a length equal to (N−1) times the standard pitch, the aperture being formed on the aperture means in position to confront the light source body.

As described above, the light source body is typically comprised of light emitting devices such as LEDs. Instead, other type of light emitting devices such as discharge tubes or semiconductor lasers may be available. The light source body is preferably like a surface illuminant in view of characteristics, but may be a point light source. A beam collimating means, a beam-condensing means, an image forming optical system or the like may be provided between the light source body and the aperture or the print paper, or a shutter capable of being electronically controlled such as a mechanical shutter or a liquid crystal shutter may be provided therebetween. To make up the upstream side light source having a length by a factor of (N−1), the light source body facing the elongated aperture may be formed of a plurality of (e.g., N pieces of) light emitting devices that are simultaneously controlled, or otherwise a single light emitting device as a whole.

Any color may be available for the color of the light source, including white color or colors of any color phase, as described above. However, as in the foregoing description, when the light source consists of a light source body and an aperture, the above-described structure capable of maximizing the dot resolution is preferably adopted for a light source having a color in a long wavelength region where the beam passing through the aperture can be easily diffused, i.e., red or red-like color, One reason why the beam in a longer wavelength region can be more easily diffused than the beam in a shorter wavelength region is that the angle of divergence when a divergent beam (having a relatively large angle of beam divergence) having a beam diameter narrowed at the aperture (diaphragm) is refracted at a transparent protective layer on the surface of the photosensitive print paper less decreases with the longer wavelength of the light. In other words, this is because when the beam is refracted at the surface of the protective layer, and thereafter reaches a photosensitive layer (e.g., a layer to which photosensitive microcapsules are applied) positioned under the protective layer, the beam diameter will be increased with the longer wavelength of the light. In some cases, a diffraction that occurs at an outer edge of the aperture (opening) may be one reason thereof.

If light source of a second color is used as the light source, a second light source group different in color from the first light source group is juxtaposed with the first light source group. That is, the print head may be further provided with a second light source group having a different color. The second light source group is disposed in position shifted in the scanning direction relative to the first light source group, typically at either side in the scanning direction. The second light source group may be provided with light sources that are arrayed at the standard pitch. However, preferably, the second light source group includes a plurality of light sources that are arranged at a pitch corresponding to the paper feeding pitch in the paper feeding direction. Typically, the second light source group is arrayed in a line along the paper feeding direction. In some cases, however, it may be shifted in the scanning direction. In this case, some of the light sources belonging to the first light source group and some of the light sources belonging to the second light source group may be aligned in a line along the paper feeding direction. Typically, a light source of a color in the longer wavelength such as red is used as the first light source group in order to form a dot having a high resolution relative to the light beam in the longer wavelength where the dots tend to be expanded. Then, a light source of a color in the lower wavelength such as blue or green is used as the second light source group to provide the dot pitch having a low resolution in coincidence with the paper feeding pitch. However, in some cases, the reverse may be true. In the second light source group in which the light sources are arranged at the paper feeding pitch, each light source has a length in the paper feeding direction equal to (N−1) times the standard pitch so that the dots may be formed in the entire region in the paper feeding direction.

If a third color light source is used as the light source, a third light source group is typically provided at either side in the scanning direction over the entirety of the first and the second light source groups. In some cases, however, light sources in the third light source group may be arranged to be shifted along the scanning direction. In this case, at least some light sources out of the light sources in the third light source group may be arrayed in a line in the paper feeding direction together with at least some light sources out of the light sources in the first and the second light source groups. The third light source group (1) may include, as the first light source group does, N pieces of light sources at the standard pitch along the paper feeding direction, and the light sources may be composed of an aperture means having N pieces of apertures arranged at the standard pitch along the paper feeding direction, and N pieces of light source bodies (for example, LEDs) arranged at an interval behind the aperture means so as to confront the apertures, respectively; or (2) may include, as the second light source group does, a plurality of light sources arranged at the paper feeding pitch in the paper feeding direction.

In the former case, as is the case of the first light source group, preferably, the third light source group includes upstream side light sources of the further different color at an interval corresponding to the standard pitch positioned at an upstream side of the N pieces of apertures of the light source group, the upstream side light source having a length in the paper feeding direction equal to (N−1) times the standard pitch, and the upstream side light source is composed of: a light source body; and an aperture in an elongated hole form having a length equal to (N−1) times the standard pitch, the aperture being formed on the aperture means in position to confront the light source body. In this case, by way of example, when the first light source group consists of red light sources, typically, a blue light source is used as the second light source group, and a green light source is used as the third light source group. However, the reverse may be true with the colors of the second light source group and the third light source group. Further, the colors of the three light source groups may not be limited on the chromatic primary colors, but may be a combination of arbitrary colors. In some cases, a combination of colors may be further selected, considering the color-sensitivity of the print paper, characteristics available in colors of the light sources (intensity, beam diameter, or angle of divergence), etc.

In the latter case, preferably, each of the light sources in the third light source group has a length equal to (N−1) times the standard pitch in the paper feeding direction as is the case of the light sources in the second light source group. In this case, typically, when the first light source group consists of red light sources, blue light source and green light source are used as the second light source group and the third light source group, by way of example. Similarly to the above case, however, the color kinds and a combination thereof may be suitably selected. Further, depending upon the photosensitive characteristic of the print paper, a light source of an ultraviolet or infrared region which is substituted for the light source of a visible region may be used as a light source.

While the use of the light source group(s) of one kind to three kinds has been described, the number of light source group may be four kinds or more. Further, it is typical that the light sources in each light source group is preferably aligned in a line so that the most upstream side light source may be in the scanning direction. In some cases, however, some light sources may be in position shifted in the paper feeding direction in view of a whole length of a plurality of the light source groups arranged in the paper feeding direction, etc.

In order to achieve the above-described object, a printer of the present invention is equipped with a printer head having the foregoing structure. It is to be noted that the photosensitive print paper to be used for the printer is typically the one to which photosensitive microcapsules have been applied in view of easiness of handling and the like. The "photosensitive microcapsule" used herein means a minute capsule so arranged as to be easily collapsed by pressure or hardly be collapsed (that is, a latent image is formed) upon reception of the light of a specific wavelength region, as well as a minute capsule in which a color-emitting material capable of color-emitting (that is, developing) a specific color upon the collapse is accommodated (typically, encapsulated). Note that the print paper can be of any other type which is photosensitive.

BRIEF DESCRIPTION OF THE DRAWINGS

In the accompanying drawings:

FIGS. 3A and 3B are explanatory diagrams describing an exposure operation using the printer head of FIG. 2, in which FIG. 3A is an explanatory sectional view of an exposure head and print paper opposite thereto, viewed in a section parallel to a paper feeding direction and orthogonal to the paper, and FIG. 3B is an explanatory diagram of a latent image to be formed on the print paper by the exposure head.

DETAILED DESCRIPTION OF THE PREFERRED EMBODIMENTS

Figure 1:
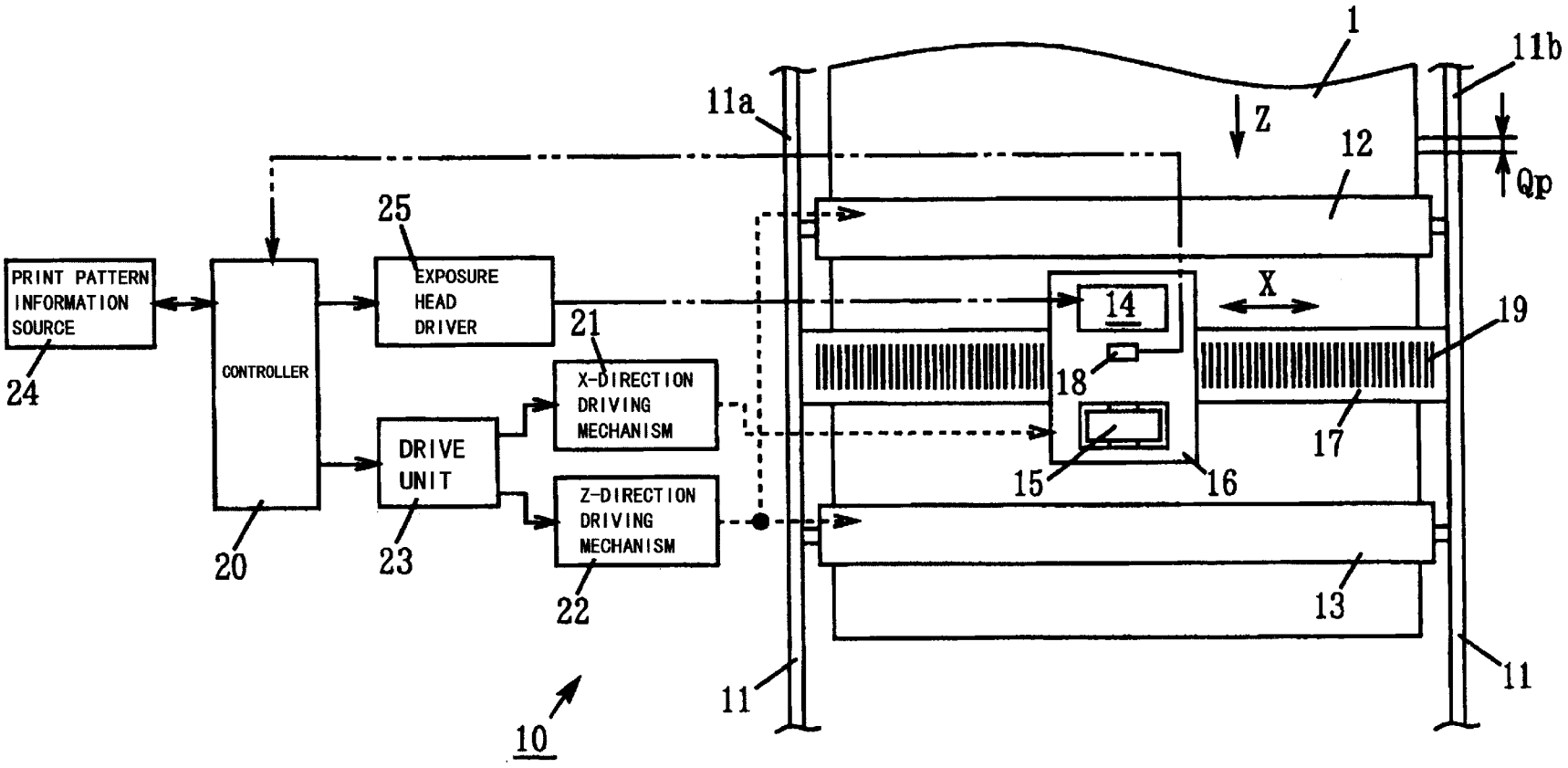
FIG. 1 is a schematic explanatory diagram of an example of a printer to which a printer head according to a preferred embodiment of the present invention is applied.

One preferred embodiment mode according to the present invention will be described with reference to a printer of one preferred embodiment illustrated in the accompanying drawings.

To begin with, photosensitive print paper 1 of one preferred embodiment used in a printer 10 shown in FIG. 1 will be described with reference to FIGS. 3A and 4.

In this embodiment, the photosensitive print paper 1 indicates that "a sheet-like material to which photosensitive microcapsules have been applied and onto which a print can be made through an exposure operation (a latent image formation operation) by using an exposure head and a pressure development operation by using a pressure development head." The sheet-like material may have any three-dimensional geometry having a width, length, and thickness so that the material can be intermittently supplied in a paper feeding direction upon printing. As illustrated in FIG. 3A, the print paper 1 is made up of a sheet-like base (base material) 2 made of white PET (polyethylene terephthalate), an image receiving layer 3 formed on this sheet-like base 2 which includes a color developer, a photosensitive microcapsule layer 4 formed by uniformly applying onto the image receiving layer 3 photosensitive micorcapsules dispersed uniformly through a binder (adhesive), and a protective layer 5 made of transparent PET. The sheet base or base material 2 may be made of other materials such as paper than a plastic material. The microcapsule layer 4 may not contain the binder, and the image receiving layer 3 and the microcapsule layer 4 may be mixed and formed into a single layer. The photosensitive microcapsule is formed with an outer transparent capsule wall of about several microns which is made of gelatin or the like. Inside the capsule wall encapsulated are a photo-curing material that can be cured with the light of the specific wavelength, and a chromogenic material for developing colors by contacting with the color developer of the image receiving layer 3 when the capsules which have not cured are collapsed by pressure. Typically, each microcapsule is designed to encapsulate both a chromogenic material for developing any of the primary colors of paint when contacting with the color developer, and the photo-curing material which can be cured with the light of a color (chromatic primary colors) in a substantially complementary relation with the color developed by the chromogenic material. That is, there are three types of microcapsules, i.e., M, Y, and C. The Type M microcapsule is designed to encapsulate a color-emitting material for magenta (M) appearing red (reddish purple) and a photo-curing material for selectively absorbing green light (G) in a complementary relation therewith to cure. The Type Y microcapsule is designed to encapsulate a color-emitting material for yellow (Y) appearing yellow and a photo-curing material for curing with blue light beam (B). The Type C microcapsule is designed to encapsulate a color-emitting material for cyan (C) appearing blue (bluish purple) and a photo-curing material for curing with red light beam (R). These three kinds of microcapsules are evenly dispersed on and applied to the microcapsule layer 4.

For example, when a color print is made by 300 dpi onto the print paper, a single dot is formed in a region having a diameter of about 85$\mu$. If this dot region is irradiated with, for example, red light from an exposure head, the photo-curing material in the Type C microcapsule is cured, while neither photo-curing material in the Type M nor Type Y microcapsule is cured. Then, a latent image of red color is formed in this dot region. If this dot region is under pressure, the Type C microcapsule which has been cured is maintained as it is, while the Type M and Type Y microcapsules which have not been cured are both collapsed by pressure, where the color-emitting materials therein are reacted with the color developer on the image receiving layer 4, appearing reddish purple and yellow, thus exhibiting substantially red as a whole. To what extent the Type C microcapsule is cured depends upon the intensity of light (the amount of light) irradiated onto the dot region. Depending upon the more or less intensity, the type C microcapsule is a little collapsed or is not collapsed at all, resulting in a varying amount of blue color mixed in the dot region. Therefore, the microcapsules of the three types varies in cure depending upon the color of the irradiated light, resulting in different color development caused by the collapse of microcapsules.

In the foregoing description, the microcapsules consists of the ones of the three types of M, Y and C capable of respectively developing colors according to the light in the three kinds of wavelength regions corresponding to the primary colors of light. Instead, there may be microcapsule (s) of one or two, or more of the arbitrary number of types capable of developing colors according to the light in one or two, or more of any particular wavelength region(s). The microcapsules of the respective types are typically distributed on the coated surface of the paper 1 in a uniform manner; however, in some cases, the microcapsules may be differently distributed depending upon regions on the paper 1.

Figure 4:
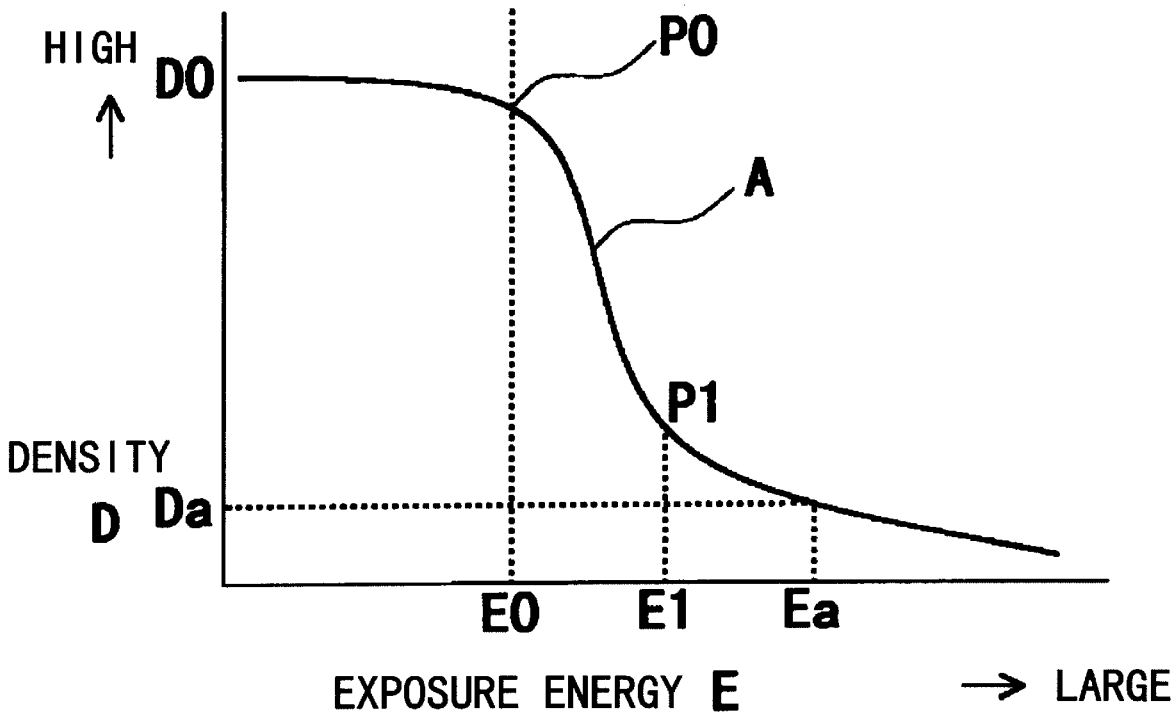
FIG. 4 is a graph describing a photosensitive characteristic of a microcapsule layer in print paper by way of example to be printed by the printer head of FIG. 2.

In common, each of the microcapsules on the print paper 1 has such photosensitive characteristics as shown in FIG. 4. Specifically, when visible light in any specific wavelength region (for example, red light R) is irradiated onto a specific region on the print paper 1, there is such a relation as indicated by a curve A in FIG. 4 between energy of the light R that is irradiated onto the specific region on the print paper 1, namely, the amount of light or integral intensity E, and density D of the complementary color that is to be developed on the specific region according to the irradiated light R. That is, if the total amount of the irradiation or exposure energy E is low, more specifically, if the exposure energy E is equal to or less than the threshold value E0 indicated by a point P0, the photo-curing material in the type C microcapsule is hardly cured in fact. The microcapsule C is collapsed by the pressure development process, resulting in color emission at a substantially constant density D0, regardless of the more of less irradiation amount E of the light R. On the other hand, if the total amount E of energy of irradiation of the light R in a specific wavelength region to the specific region of the print paper 1 exceeds the threshold energy E0, in a range where the total amount E of irradiation energy is substantially lower than the energy E1 as indicated by a point P1, the cure of the photo-curing material abruptly fluctuates (increases) as the irradiation energy E increases. The pressure development process causes the collapse of the microcapsule C to abruptly decrease, and the density D of color emission to abruptly decrease. When the exposure energy E turns to approximately E1, the microcapsule C hardly tends to be collapsed with the pressure development. Thus, when the exposure energy E passes E1, a decrease of the density D of color emission with an increase of the exposure amount E will be again lowered. The point P1 represents a possibly criterial point or region to qualitatively present the exposure and color emission characteristics. However, this point is not necessarily defined to be strictly discriminated from points adjacent thereto. In the foregoing discussion, while the characteristics of the type C microcapsule to the red light R has been described by way of example, it will be appreciated that the other microcapsules M and Y also have qualitatively similar characteristics (in some cases, quantitatively similar in effect) to the G, B lights in the wavelength, respectively corresponding thereto.

Referring to FIG. 1, in the printer 10, the sheets of print paper 1 are intermittently fed in a direction Z at a constant pitch (a paper feeding pitch) Qp by paper feed mechanisms 12, 13 such as rollers located at the upstream side and the downstream side which are supported between side walls 11*a*, 11*b* of a frame 11 of the printer 10. While a supply of the paper 1 in the paper feeding direction Z is stopped, a carriage 16 equipped with an exposure head 14 and a pressure/development head 15 scans in a scanning direction X orthogonal to the paper feeding direction Z along a guide mechanism 17 such as a guide rail. The scanning of the carriage 16 may be performed by running timing belts around timing pulleys mounted at the both ends in the scanning direction to be circulated, and by engaging pins fixed to the timing belts with an elongated hole in the paper feeding direction which is formed in the carriage 16. Otherwise, the scanning may be performed by extending a shaft in the scanning direction in a rotatable manner about its axis line, and by engaging engagement pins formed integrally on the carriage 16 with a threaded groove in the both directions which is formed in an outer circumference of the shaft. Other means than the above may be available therefor. A scanning position sensor or an encoder 18 integrated with the carriage 16 reads the scale of a scale 19 on the guide rail 17, and then sends it to a controller 20, thereby detecting the position in X-direction of the exposure head 14. The pressure/development head 15 has the following structure. Upon moving in the direction X as the carriage 16 scans in the direction X, the head 15 cooperates with a paper supporting means such as a platen which is positioned behind the print paper 1 to apply pressure force to a exposed part of the sheet (a subregion of the paper 1) between the paper supporting means which is positioned ahead of the head 15. Then, uncured or incompletely cured microcapsules in the exposed part are collapsed by pressure so as to develop a predetermined color with predetermined density to this sheet part of the paper 1. The head 15 is provided with, for example, a pressure roller capable of turning in the scanning direction on the paper 1 supported by the supporting means. Reference numeral 21 denotes an X-direction driving mechanism for driving the carriage 16 in the direction X; 22, a Z-direction driving mechanism for intermittently moving the paper 1 through the paper feed mechanisms 12, 13; and 23, a driving source including a power transmission mechanism and driving the driving mechanisms 21, 22, respectively.

The image information to be printed and the like are given to the controller 20 of the printer 10 from an image information processor such as a digital camera or a print pattern information source 24 such as an image information recording medium. Based on the pattern information from the print pattern information source 24 and the X-direction position data from the scanning position sensor 18, the controller 20 constituted of a microprocessor and the like drives an exposure head driver 25 at each paper feeding position Z to cause the exposure head 14 to form a dot-like latent image having a predetermined color and photosensitivity (degree of cure) at the positions X, z on the paper 1. The latent image is formed in the direction X as the exposure head 14 scans in the direction X. Such a operation is repeated that the sheets of paper 1 are intermittently fed in the direction Z by one pitch and thereafter scanned by the exposure head 14 in the direction X, so that the latent image in a two-dimensional pattern form is formed on the paper 1 on the surface defined by X-Z. The pressure/development head 15 moved in the direction X at the same time when the exposure head 14 scans in the direction X applies pressure to the exposed area on the sheet of paper 1. Then, the microcapsules are collapsed by pressure according to the exposure (photosensitive) state in each dot region, resulting in development.

Figure 2:
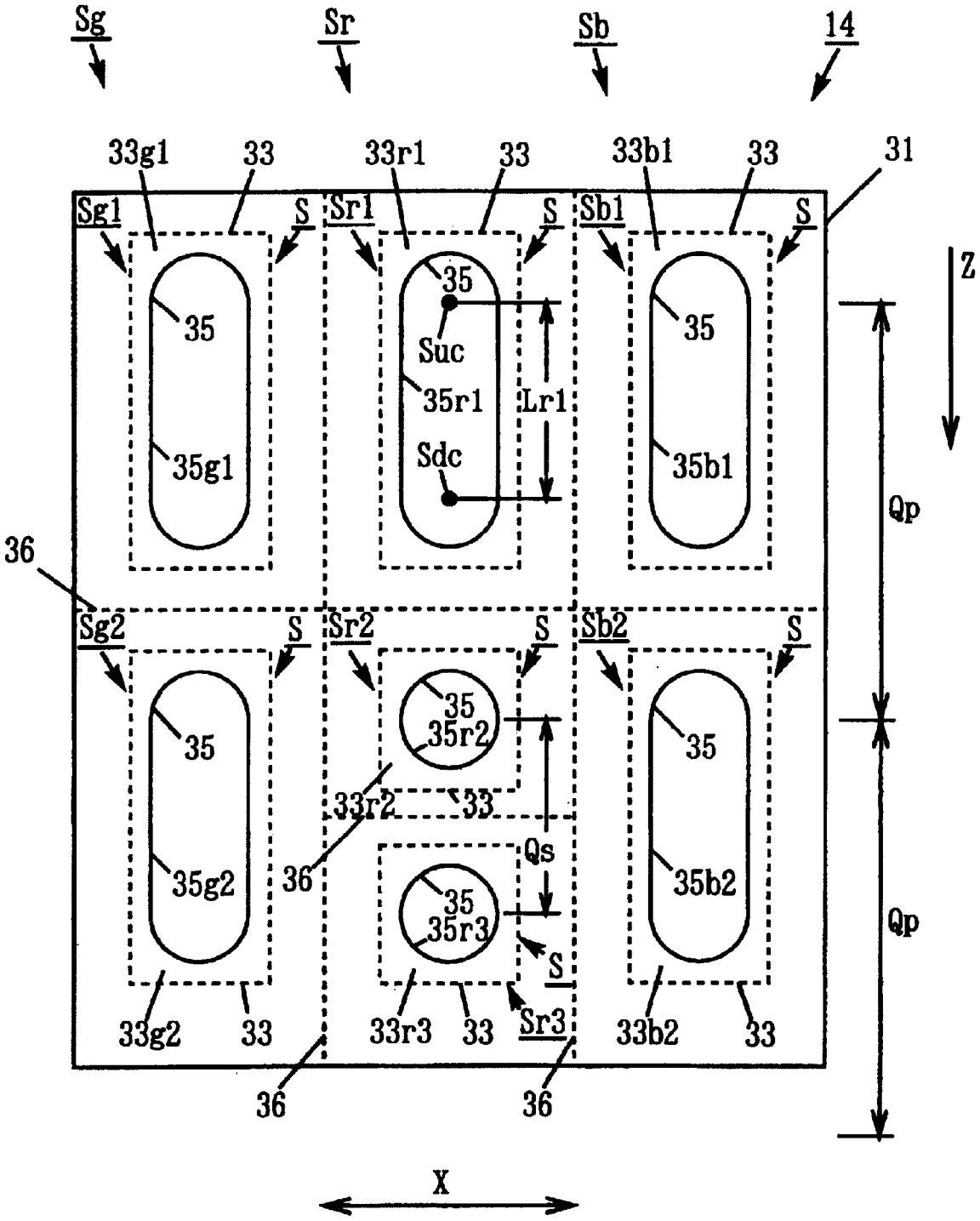
FIG. 2 is an explanatory diagram of a printer head according to a preferred embodiment of the present invention, viewed from the front of the head.
Figure 3A:
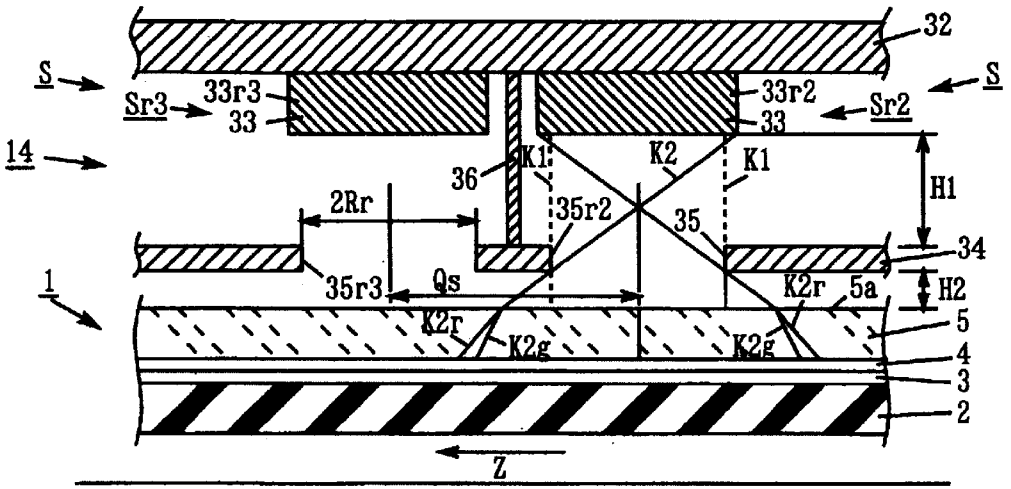

As shown in FIGS. 2 and 3A, the exposure head 14 comprises a box-shaped head housing 31; a plurality of LEDs 33 serving as light source bodies which are arrayed and fixed to a rear wall 32 of the head housing 31 in the direction z and the direction X; and apertures (diaphragms) 35 formed in the position facing the light source bodies 33, respectively, on a front wall 34 (having a thickness of, for example, about several ten $\mu$) of the head housing 31 at the spacing of distance H1 (having a length of, for example, about 300 to 400$\mu$). Reference numeral 36 denotes a separator wall (partition wall) formed between the light source bodies 33, 33. The front wall 34 functions as an aperture means or an aperture plate. The light source bodies 33 separated from one another by the separator wall 36, and the apertures 35 respectively facing the light source bodies 33 form light sources S, respectively.

More specifically, a plurality of the light sources S of the exposure head 14 comprise: a group of red light sources Sr serving as a first light source group; a group of green light sources Sg serving as a second light source group (or a third light source group) which is arranged at the left side of the red light source group Sr with respect to the scanning direction X (as viewed in FIG. 2); and a group of blue light sources Sb serving as a third light source group (or a second light source group) which is arranged at the right side of the red and green light source groups Sr, Sg with respect to the scanning direction. In the embodiment illustrated in the figures, N=2, and the standard pitch Qs=Qp/N=Qp/2. The red light source group Sr consists of two round red light sources Sr2, Sr3 each having a radius Rr, which are arrayed in the paper feeding direction Z at the standard pitch Qs=Qp/2, i.e., ½ of the paper feeding pitch Qp, and an elongated red light source Sr1 having a length Lr1=(N−1) Qs=Qs=Qp/2, which is arranged at the more upstream side than the upstream side red light source Sr2 at an interval Qp/2 corresponding to the standard pitch Qs. As used herein, the length Lr1 of the elongated upstream side light source Sr1 refers to a distance between the center of the semi-circle Suc having the radius Rr at the upstream end of the light source Sr1 and the center of the semi-circle Sdc having the radius Rr at the downstream end of the light source Sr1. Meanwhile, the interval between the light sources Sr1 and Sr2 refers to a distance between the point Sdc and the center of the round light source Sr2. The green light source group Sg consists of elongated light sources Sg1, Sg2 each having substantially the same shape as that of the light source Sr1, which are arranged at the interval corresponding to the standard pitch Qs. Also, the blue light source group Sb consists of elongated light sources Sb1, Sb2 each having substantially the same shape as that of the light source Sr1, which are arranged at the interval corresponding to the standard pitch Qs. It is to be noted that at least one of the light sources Sg and Sb may be formed of a light source having a similar shape and arrangement to that of the red light source group Sr.

In the embodiment illustrated in the figures, since the shape, size, and positional relation of each light source S are substantially defined by the apertures 35 that serve as diaphragms, the foregoing description for the shape, size and positional relation of the light source S is also applied to each of the apertures 35 without any change, except that otherwise is particularly described to discriminate between the light sources S and the apertures 35. Hereinbelow, the apertures 35 respectively corresponding to the light sources S will be illustrated given by indices (r1, etc.) identical with indices for the light sources S (e.g., r1, etc.). The light source bodies 33 such as LEDs will be also shown given by indices (r1, etc.) corresponding thereto.

In the embodiment shown in FIG. 2, the light sources Sr2, Sr3 are round, and the other light sources Sr1, Sb1, . . . , Sg2 are of an ellipse elongated in the direction Z. Instead, the light sources Sr1, Sb1, . . . , Sg2 may be round, and the rest of light sources Sr2, Sr3 may be of an ellipse elongated in the direction X, or the light sources which are near the round ones may be relatively elongated elliptical, etc.

Figure 3B:
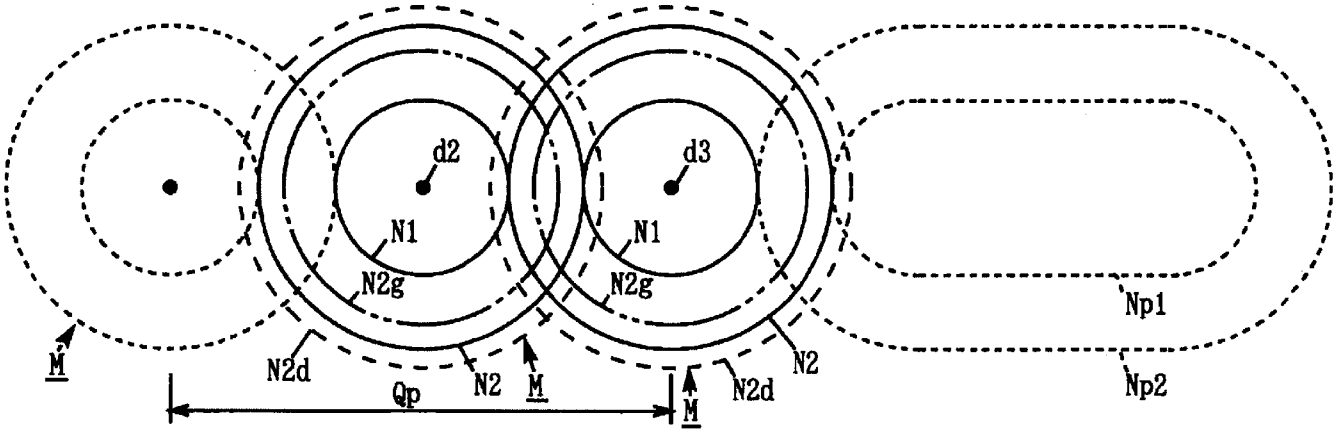

Next, a formation of a latent image M by using the light sources S on the print paper 1 positioned apart from the aperture plates 34 of the light sources S by a distance of H2 (for example, about several ten $\mu$) will be described with reference to FIGS. 3A and B. As shown in FIG. 3A, within a region defined by a line K1 indicating a cylindrical outline surface (corresponding to an opening diameter 2R, having a length of about 200 to 300$\mu$, for example), the light from almost all regions of the light source body 33*r*2 is irradiated onto a microcapsule layer 4 via a protective layer 5 (having a thickness of about 50 to 100$\mu$, for example) of the print paper 1. Therefore, the sheet area in a circle N1 that corresponds to the above region can be sufficiently exposed by the light from the light source body 33*r*2. However, the light from the light source body 33*r*2 is not irradiated onto the outside of an area defined by a line K2. Therefore, the points where the light along the line K2 is irradiated onto the microcapsule layer 4 via the transparent protective layer 5 forms an outer edge of the region that is exposed with the light source body 33*r*2 or the light source Sr2. Taking into account a refraction on a top surface 5*a* of the transparent protective layer 5, in FIG. 3A, the red light is refracted as indicated by a solid line K2*r*, and then irradiated onto the transparent protective layer 5. As a result, as in FIG. 3B, the outer edge of the dot (exposed region) for the red light exhibits a circle (having a diameter of, for example, about 300 to 400$\mu$) as indicated by a solid line N2. For simplification of the description, it is now assumed that the light emitting surface of the light source body 33*r*2 be round (the outer edge N2 depends upon the shape of the aperture as well as the shape of the light source body 33*r*2).

Given that the light source be not a red light source but a light source of a green light (or a blue light) in a shorter wavelength than that of the red light, a larger refraction will take place on the surface of the transparent protective layer 5. As indicated by an imaginary line K2*g* in FIG. 3A, the light is refracted more inwardly, and then irradiated onto the microcapsule layer 4. Therefore, as indicated by an imaginary line N2*g* in FIG. 3B, the outer edge of the exposed region of the microcapsule layer 4 will be a circle having a smaller diameter than that indicated by N2. Incidentally, in the case where the diffraction at the outer edge of the opening 35*r*2 of the aperture plate 34 may not be ignored, since an increase of the diameter accompanying with the diffraction will be made larger as the wavelength is longer, the diffraction causes the light beam K2 to extend more outwardly (given that the diffraction of the light having a short wavelength can be ignored). The outer edge of the dot will be then more expanded than the area indicated by N2, as indicated by a broken line N2*d* in FIG. 3B. As a result, within the region ranging from the outer edge N1 of the central round region to the outer edge of the dot N2 or N2*d*, the amount of the irradiated light decreases as approaching outwardly in the radial direction, so that this region appears a blurred outline. Hence, the light having a longer wavelength may provide a more expanded blurred region (diameter). Accordingly, if the light sources of three colors (in this embodiment, diaphragms 35) having the same size and shape are formed, there will be an increase of the possibility that the dot image formed by the red light of the longest wavelength may be most blurred. As shown in FIG. 2, however, this head 14 may provide a less possibility that the dot formed by the red light becomes blurred and largely expanded, because the red light source group Sr is so arranged that the light sources Sr2, Sr3 smaller in sizes are used to array a larger number of light sources, unlike the green light source group Sg and the blue light source group Sb.

Then, an exposure (a latent image formation) by using the red light source Sr will be described in detail, including a pre-exposure. To begin with, it is assumed that the most upstream side light source Sr1 pre-expose onto predetermined positions Z1, X1 in the directions Z, X on the print paper 1 while a supply of the sheets of print paper 1 is stopped in the direction Z. In this regard, by way of example, a pre-exposure is almost uniformly performed onto the inside of the region indicated by a dotted line Np1 in FIG. 3B, as is the case of the region N1. Then, within the region indicated by a dotted line Np2, a pre-exposure is performed so as to decrease the light receiving amount as the line Np1 outwardly approaches the line Np2. That is, the region encircled with the line Np1 is supplied with light energy equal to the threshold energy E0 indicated by the threshold point P0 in FIG. 4 or slightly lower than this, and the irradiation light energy is made lower as approaching the outer side in the region between the lines Np1 and Np2. After the paper feeding position Z1 is scanned in the direction X, the sheet of paper 1 is fed by a feeding pitch Qp to the downstream side by the paper feed mechanisms 12, 13. When the X-direction scanning of the carriage 16 allows the red light source Sr of the exposure head 14 to face the pre-exposed positions Z1, X1 on the paper 1, the two red light sources Sr2, Sr3 at the downstream side of the head 14 are then driven for color emission to provide light energy of, for example, (Ea−E0) in FIG. 4 from the light sources Sr2, Sr3 (where, for example, Ea>E1, but Ea<E1 may be possible in some cases). Then, a latent image is formed so that the regions N1, N1 facing the light sources Sr2, Sr3, respectively, attain predetermined density Da (when the microcapsule is collapsed by pressure). Accordingly, two dot latent images containing at least the regions N1, N1 are formed about the points d2, d3 as the center with respect to the paper feeding direction Z. Out of the paper regions corresponding to the region outside the area defined by the line N1 in the beam section from the light source Sr2 and the region outside the area defined by the line N1 in the beam section from the light source Sr3, a latent image that provides the density D substantially similar to those of the regions N1, N1 is formed in the area where the total amount of light receiving energy exceeds E1. For example, at least most of the area where the two beams N2, N2 overlap corresponds to this range. As a result, the dot regions having as the center the points d2, d3 are actually connected to each other. Incidentally, when no latent image is formed in the dot region adjacent to the dot region at the position X1 as viewed in the scanning direction X, there is reduced density in the dot region apart toward the both ends of the scanning direction X. However, since the microcapsule of the paper 1 has such photosensitive characteristics as in FIG. 4, the density varies with much larger gradient than the gradients of the irradiation light energy, so that the dot image is limited within a certain are. On the other hand, when a latent image is formed in the region adjacent to the dot region at the position X1 as viewed in the scanning direction X, the regions will be actually connected to each other also in the scanning direction X.

During the exposure operation having the foregoing structure, with respect to the red light, two dots are formed within a range of the paper feeding pitch Qp. Therefore, when the paper feeding pitch Qp is identical with the conventional paper feeding pitch in magnitude, a dot increased by a factor of two are formed within the pitch Qp (given N=2), to thereby make the dot pitch ½, so that the print resolution (dot resolution) to the red light doubles. Consequently, a print corresponding to the red light that tends to produce a blur can be more clearly formed. It should be noted that in this embodiment, conventional techniques may be adopted with respect to the green light source Sg and the blue light source Sb in a similar manner in which a single dot latent image can be formed through two exposure operations (pre-exposure and subsequent exposure for a latent image formation) performed by the light sources Sg1, Sg2 and the light sources Sb1, Sb2 in the dot regions, respectively.

Meanwhile, when the standard pitch Qs is identical with the pitch of the light sources in the conventional print head, the paper feeding pitch Qb is equal to two times the standard pitch Qs (given N=2), and the paper feeding pitch Qp will double the conventional paper feeding pitch while the light source pitch, i.e., the dot pitch, can be maintained at a constant level. Consequently, the print speed can be much increased as compared with the conventional one. For example, as described above, if an exposure time per dot is 480 microseconds, the number of dots in the scanning direction is 320 dots per line, the inverse time in the scanning direction at the end of the scanning direction (the end of one line) is 0.05 seconds, and the number of dots (the number of lines) in the paper feeding direction is 144 dots, the printing time will be $(480\times320\times10^{-6}+0.05)\times144/2$ seconds, i.e., approximately 14.7 seconds, which can be reduced by half as compared with the conventional one. In this case, the dot resolution is reduced for the green light source Sg and the blue light source Sb in view of a single dot region substituting for the two dot regions. However, considering that a blur is relatively increased to the red light at the same resolutions, reduction in resolution as compared with the case of the red light will rather provide a blur at an even level as a whole. Hence, while the resolutions are balanced for the light for the respective colors, the total printing speed can be increased.

The foregoing description has been mainly made of an embodiment where the light relatively weak enough to present a blurred outer edge of the dot is provided. When light energy is increased, an increased expansion of the dot works in this exposure head 14 in order to shift the colors in the adjacent regions from a predetermined color as the adjacent dots overlap. However, the resolution of the dot-like latent image (thus, the resolution of the dot-like color development region formed through the development) formed by the light in a longer wavelength region is relatively increased as compared with the resolution of the dot region formed by the light in a shorter wavelength, so that a deviation in the color development between the adjacent dot regions can be inhibited to minimum.

When a print is considered as a formation of visible images, the printer head in the foregoing embodiment is constituted of the exposure head 14 and the pressure/development head 15. Meanwhile, when the pressure/development operation is considered as a development of colors following the exposure result, and the print pattern is considered to be practically defined by the exposure operation, the printer head practically constituted of the exposure head 14, excluding the pressure/development head 15.

While FIG. 2 illustrates an embodiment where the light sources of the respective colors (the respective groups) are aligned in a line along the paper feeding direction, such a exemplification may be available that the light source positioned at the second row corresponds to the one shown in the illustrative example and the light source positioned at the first row is different in colors from the one shown in the illustrative example; Sg1 may be a red light source, Sr1 may be a blue light source, and Sb1 may be a green light source. Further, the light sources Sg1, Sr1, Sb1 positioned at the first row may not be aligned in a line in the scanning direction. In addition, the light source groups may include Srs only, or Srs plus Sgs, or the light source groups may be different in colors from the one shown in the embodiment. Additionally, N may be 3 or more. Given N=3, for example, in FIG. 2, sub-light sources Sr2, Sr3, Sr4 each having the radius Rr will be arranged. Then, Qs=Qp/3, and Lr1=(N−1)Qs=2Qs will be found.

What is claimed is:

1. An optical writing printer head for printing onto photosensitive print paper having a photosensitive microcapsule layer, which is intermittently fed at a constant paper feeding pitch in a paper feeding direction, by irradiating light onto the photosensitive print paper so that the light is scanned across the paper in a scanning direction intersecting the paper feeding direction, the printer head comprising: a first light source group comprising a plurality of light sources arranged adjacent each other along the paper feeding direction, the first light source group including N light sources for producing light of a first color arranged in an array extending in the paper feeding direction at a standard pitch of 1/N of the paper feeding pitch, where N is a natural number having a value of 2 or larger.

2. A printer head as claimed in claim 1; wherein the first light source group includes an upstream side light source of the first color and N−1 light sources adjacent the upstream light source in the paper feeding direction at an interval corresponding to the standard pitch, the upstream side light source having a length in the paper feeding direction equal to (N−1) times the standard pitch.

3. A printer head as claimed in claim 2; wherein the N light sources comprise an aperture member having N apertures arranged at the standard pitch along the paper feeding direction, and N light emitting elements arranged behind the aperture member so as to confront the respective apertures and emit light therethrough onto the print paper.

4. A printer head as claimed in claim 3; wherein the upstream side light source having a length equal to (N−1) times the standard pitch comprises an upstream light emitting element and an elongated aperture having a length in the paper feeding direction equal to (N−1) times the standard pitch, the elongated aperture being formed on the aperture member to confront the upstream light source body.

5. A printer head as claimed in claim 1; wherein the first color is red.

6. A printer head as claimed in claim 1; further comprising a second light source group of a second color different from the first color, the second light source group including a plurality of light sources for producing light of the second color arranged at the paper feeding pitch in the paper feeding direction.

7. A printer head as claimed in claim 6; wherein the light sources in the second light source group each have a length equal to (N−1) times the standard pitch in the paper feeding direction.

8. A printer head as claimed in claim 6; further comprising a third light source group of a third color different from the first and second colors.

9. A printer head as claimed in claim 8; wherein the third light source group includes N light sources for producing light of the third color arranged at the standard pitch along the paper feeding direction, the light sources of the third color comprising an aperture member having N apertures arranged at the standard pitch along the paper feeding direction, and N light emitting elements for emitting light of the third color arranged behind the aperture member so as to confront the respective apertures.

10. A printer head as claimed in claim 9; wherein the third light source group includes an upstream side light source of the third color at an interval corresponding to the standard pitch positioned at an upstream side of the N apertures of the third light source group and N−1 light sources of the third color adjacent the upstream light source in the paper feeding direction, the upstream side light source having a length in the paper feeding direction equal to (N−1) times the standard pitch, and the upstream side light source of the third color comprising a light emitting element for emitting light of the third color and an elongated aperture having a length equal to (N−1) times the standard pitch, the elongated aperture being formed on the aperture member to confront the upstream light emitting element of the third color.

11. A printer head as claimed in claim 8; wherein the third light source group includes a plurality of light sources arranged at the paper feeding pitch in the paper feeding direction.

12. A printer head as claimed in claim 11; wherein the light sources in the third light source group each have a length equal to (N−1) times the standard pitch in the paper feeding direction.

13. A printer head as claimed in claim 3; wherein the light emitting elements each comprise an LED (light emitting diode).

14. A printer head as claimed in claim 1; wherein N is 2.

15. A printer having a printer head as claimed in any one of claims 1 to 14.

16. An optical writing printer for printing on photosensitive print paper having a photosensitive microcapsule layer, comprising: means for intermittently feeding the photosensitive print paper at a constant paper feeding pitch in a paper feeding direction; and a print head for irradiating light onto the photosensitive print paper in an illumination direction intersecting the paper feeding direction during the intermittent feeding of the photosensitive print paper in the paper feeding direction, the print head having a first light source group comprising a plurality of light sources arranged adjacent each other along the paper feeding direction, the first light source group having N light sources for emitting light of a first color arranged in an array extending in the paper feeding direction at a standard pitch equal to 1/N of the paper feeding pitch, where N is a natural number having a value of 2 or more.

17. A printer according to claim 16; further comprising means for moving the print head in the illumination direction so that the first light source group illuminates the photosensitive print paper in the illumination direction during the intermittent feeding of the paper in the paper feeding direction.

18. A printer according to claim 16; wherein the first light source group includes an upstream light source for emitting light of the first color and one or more light sources of the first color adjacent the upstream light source in the paper feeding direction at an interval corresponding to the standard pitch, the upstream light source having a length in the paper feeding direction equal to (N−1) times the standard pitch.

19. A printer according to claim 18; wherein the N light sources comprise an aperture member having N apertures arranged at the standard pitch along the paper feeding direction, and N light emitting elements arranged behind the aperture member so as to confront the respective apertures and emit light therethrough onto the photosensitive print paper.

20. A printer according to claim 19; wherein the upstream side light source comprises an upstream light emitting member and an elongated aperture having a length in the paper feeding direction equal to (N−1) times the standard pitch, the elongated aperture being formed on the aperture member to confront the upstream light emitting element.

21. A printer according to claim 16; further comprising a second light source group adjacent the first light source group in the illumination direction for producing light of a second color, the second light source group comprising a plurality of light sources for producing light of the second color arranged at the paper feeding pitch in the paper feeding direction.

22. A printer according to claim 21; wherein the light sources in the second light source group each have a length equal to (N−1) times the standard pitch in the paper feeding direction.

23. A printer according to claim 21; further comprising a third light source group adjacent the first and second light source groups in the illumination direction for producing light of a third color different from the first and second colors, the third light source group comprising N light sources of the third color arranged at the standard pitch along the paper feeding direction.

24. A printer according to claim 23; wherein the light sources of the third color each comprise an aperture member having N apertures arranged at the standard pitch along the paper feeding direction, and N light emitting elements for emitting light of the third color arranged behind the aperture member so as to confront the respective apertures and emit light onto the photosensitive print paper.

25. A printer according to claim 24; wherein the third light source group includes an upstream light source of the third color at an interval corresponding to the standard pitch positioned at an upstream side of the N apertures of the third light source group and N−1 light sources of the third color adjacent the upstream light source in the paper feeding direction, the upstream side light source having a length in the paper feeding direction equal to (N−1) times the standard pitch, and the upstream light source of the third color comprising a light emitting element for emitting light of the third color and an elongated aperture having a length equal to (N−1) times the standard pitch, the elongated aperture being formed on the aperture member to confront the upstream light emitting element of the third color.

* * * * *